US009238953B2

(12) United States Patent
Fleming et al.

(10) Patent No.: US 9,238,953 B2
(45) Date of Patent: Jan. 19, 2016

(54) COMPLETION METHOD FOR STIMULATION OF MULTIPLE INTERVALS

(75) Inventors: John Fleming, Damon, TX (US); Gary L. Rytlewski, League City, TX (US); Larry W. Phillips, Angleton, TX (US); Jason Swaren, Sugar Land, TX (US); Aude Faugere, Houston, TX (US); Rod Shampine, Houston, TX (US); Zhanke Liu, Sugar Land, TX (US); Pete Bazan, Jr., Friendswood, TX (US); Jabus Talton Davis, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 515 days.

(21) Appl. No.: 13/291,293

(22) Filed: Nov. 8, 2011

(65) Prior Publication Data

US 2013/0112436 A1 May 9, 2013

(51) Int. Cl.

| | |
|---|---|
| ***E21B 34/14*** | (2006.01) |
| ***E21B 21/10*** | (2006.01) |
| ***E21B 23/00*** | (2006.01) |
| ***E21B 43/14*** | (2006.01) |
| ***E21B 43/26*** | (2006.01) |

(52) U.S. Cl.

CPC ..... *E21B 34/14* (2013.01); *E21B 21/103* (2013.01); *E21B 23/006* (2013.01); *E21B 43/14* (2013.01); *E21B 43/26* (2013.01)

(58) Field of Classification Search

CPC ..... E21B 34/14; E21B 21/103
USPC ..... 166/373, 374, 386, 193, 194, 318, 166/332.4

See application file for complete search history.

(56) References Cited

U.S. PATENT DOCUMENTS

| | | | |
|---|---|---|---|
| 2,223,442 | A | 12/1940 | Crowell |
| 2,374,169 | A | 4/1945 | Martin |
| 2,429,912 | A | 10/1947 | Baker |
| 2,458,278 | A | 1/1949 | Larkin et al. |
| 2,716,454 | A | 8/1955 | Abendroth |

(Continued)

FOREIGN PATENT DOCUMENTS

| | | | |
|---|---|---|---|
| EP | 2372080 | A2 | 5/2011 |
| GB | 2375558 | A | 11/2002 |

(Continued)

OTHER PUBLICATIONS

Thomson, D. W., and Nazroo, M. F., Design and Installation of a Cost-Effective Completion System for Horizontal Chalk Wells Where Multiple Zones Require Acid Stimulation, SPE 51177 (a revision of SPE 39150), Offshore Technology Conference, May 1997, Houston, TX, USA.

(Continued)

*Primary Examiner* — Cathleen Hutchins

(74) *Attorney, Agent, or Firm* — Jeffery R. Peterson; Cathy Hewitt

(57) ABSTRACT

A technique provides for stimulating or otherwise treating multiple intervals/zones of a well by controlling flow of treatment fluid via a plurality of flow control devices. The flow control devices are provided with internal profiles and flow through passages. Hydraulic darts are designed for selective engagement with the internal profiles of specific flow control devices, and each hydraulic dart may be moved downhole for engagement with and activation of a specific flow control device.

18 Claims, 8 Drawing Sheets

(56) References Cited

U.S. PATENT DOCUMENTS 3,011,548 A 12/1961 Holt
3,054,415 A 9/1962 Baker et al.
3,263,752 A 8/1966 Conrad
3,269,463 A 8/1966 Page, Jr.
3,270,814 A 9/1966 Richardson et al.
3,306,361 A 2/1967 Lebourg
3,333,635 A 8/1967 Crawford
3,542,127 A 11/1970 Malone
3,741,300 A 6/1973 Jeansonne et al.
3,995,692 A 12/1976 Seitz
4,064,937 A 12/1977 Barrington
4,099,563 A 7/1978 Hutchison et al.
4,355,686 A 10/1982 Arendt
4,429,747 A 2/1984 Williamson
4,444,266 A 4/1984 Pringle
4,520,870 A 6/1985 Pringle
4,709,760 A 12/1987 Crist et al.
4,729,432 A 3/1988 Helms
4,771,831 A 9/1988 Pringle et al.
4,813,481 A 3/1989 Sproul et al.
4,880,059 A 11/1989 Brandell et al.
4,944,348 A * 7/1990 Whiteley et al. ..... 166/278
4,949,788 A 8/1990 Szarka et al.
4,967,841 A 11/1990 Murray
5,029,644 A 7/1991 Szarka et al.
5,048,611 A 9/1991 Cochran
5,183,114 A 2/1993 Mashaw, Jr. et al.
5,224,044 A 6/1993 Tamura et al.
5,224,556 A 7/1993 Wilson et al.
5,242,022 A 9/1993 Burton et al.
5,295,393 A 3/1994 Thiercelin
5,333,692 A 8/1994 Baugh et al.
5,337,808 A 8/1994 Graham
5,361,856 A 11/1994 Surjaatmadja et al.
5,368,098 A 11/1994 Blizzard et al.
5,375,661 A 12/1994 Daneshy et al.
5,381,862 A 1/1995 Szarka et al.
5,394,941 A 3/1995 Venditto et al.
5,425,418 A 6/1995 Arizmendi et al.
5,505,261 A 4/1996 Huber et al.
5,526,884 A 6/1996 Lembcke
5,526,888 A 6/1996 Gazewood
5,579,844 A 12/1996 Rebardi et al.
5,598,890 A 2/1997 Richard et al.
5,609,204 A 3/1997 Rebardi et al.
5,660,232 A 8/1997 Reinhardt
5,692,564 A 12/1997 Brooks
5,765,642 A 6/1998 Surjaatmadja
5,848,646 A 12/1998 Huber et al.
5,887,657 A 3/1999 Bussear et al.
5,921,318 A 7/1999 Ross
5,988,285 A 11/1999 Tucker et al.
6,006,838 A 12/1999 Whiteley et al.
6,009,947 A 1/2000 Wilson et al.
6,059,032 A 5/2000 Jones
6,109,372 A 8/2000 Dorel et al.
6,112,809 A 9/2000 Angle
6,155,342 A 12/2000 Oneal et al.
6,186,227 B1 2/2001 Vaynshteyn et al.
6,186,230 B1 2/2001 Nierode
6,206,095 B1 3/2001 Baugh
6,216,785 B1 4/2001 Achee, Jr. et al.
6,220,357 B1 4/2001 Carmichael et al.
6,253,861 B1 7/2001 Carmichael et al.
6,286,599 B1 9/2001 Surjaatmadja et al.
6,302,199 B1 10/2001 Hawkins et al.
6,302,208 B1 10/2001 Walker et al.
6,333,699 B1 12/2001 Zierolf
6,333,700 B1 12/2001 Thomeer et al.
6,334,486 B1 1/2002 Carmody et al.
6,371,208 B1 4/2002 Norman et al.
6,371,221 B1 4/2002 Harrigan et al.
6,378,627 B1 4/2002 Tubel et al.
6,386,109 B1 5/2002 Brooks et al.
6,394,184 B2 5/2002 Tolman et al.
6,431,270 B1 8/2002 Angle
6,443,228 B1 9/2002 Aronstam et al.
6,446,729 B1 9/2002 Bixenman et al.
6,474,419 B2 11/2002 Maier et al.
6,520,255 B2 2/2003 Tolman et al.
6,520,258 B1 2/2003 Yang et al.
6,536,524 B1 3/2003 Snider
6,543,538 B2 4/2003 Tolman et al.
6,575,247 B2 6/2003 Tolman et al.
6,634,429 B2 10/2003 Henderson et al.
6,644,412 B2 11/2003 Bode et al.
6,655,461 B2 12/2003 Eslinger et al.
6,662,874 B2 12/2003 Surjaatmadja et al.
6,668,938 B2 12/2003 Sheffield et al.
6,672,405 B2 1/2004 Tolman et al.
6,675,891 B2 1/2004 Hailey et al.
6,719,051 B2 4/2004 Hailey et al.
6,719,054 B2 4/2004 Cheng et al.
6,725,933 B2 4/2004 Middaugh et al.
6,725,934 B2 4/2004 Coronado et al.
6,729,416 B2 5/2004 Contreras et al.
6,732,803 B2 5/2004 Garcia et al.
6,759,968 B2 7/2004 Zierolf
6,761,219 B2 7/2004 Snider et al.
6,782,948 B2 8/2004 Echols et al.
6,799,633 B2 10/2004 McGregor
6,808,020 B2 10/2004 Garcia et al.
6,843,317 B2 1/2005 Mackenzie
6,880,402 B1 4/2005 Couet et al.
6,880,638 B2 4/2005 Haughom et al.
6,886,406 B1 5/2005 Couet et al.
6,907,936 B2 6/2005 Fehr et al.
6,951,331 B2 10/2005 Haughom et al.
6,953,094 B2 10/2005 Ross et al.
6,962,215 B2 11/2005 Curtis et al.
6,994,170 B2 2/2006 Echols
6,997,263 B2 2/2006 Campbell et al.
7,021,384 B2 4/2006 Themig
7,066,264 B2 6/2006 Bissonnette et al.
7,066,265 B2 6/2006 Surjaatmadja
7,093,664 B2 8/2006 Todd et al.
7,096,945 B2 8/2006 Richards et al.
7,108,065 B2 9/2006 Bertoja et al.
7,108,067 B2 9/2006 Themig et al.
7,124,831 B2 10/2006 Turley et al.
7,128,152 B2 10/2006 Anyan et al.
7,128,160 B2 10/2006 Anyan et al.
7,134,505 B2 11/2006 Fehr et al.
7,150,318 B2 12/2006 Freeman
7,165,621 B2 1/2007 Ayoub et al.
7,168,494 B2 1/2007 Starr et al.
7,191,833 B2 3/2007 Richards
7,210,533 B2 5/2007 Starr et al.
7,228,912 B2 6/2007 Patel et al.
7,231,978 B2 6/2007 Rivas et al.
7,267,172 B2 9/2007 Hofman
7,322,417 B2 1/2008 Rytlewski et al.
7,325,616 B2 2/2008 Lopez de Cardenas et al.
7,325,617 B2 2/2008 Murray
7,353,879 B2 4/2008 Todd et al.
7,363,967 B2 4/2008 Burris et al.
7,377,321 B2 5/2008 Rytlewski
7,385,523 B2 6/2008 Thomeer et al.
7,387,165 B2 6/2008 Lopez de Cardenas et al.
7,395,856 B2 7/2008 Murray
7,431,091 B2 10/2008 Themig et al.
7,464,764 B2 12/2008 Xu
7,467,685 B2 12/2008 Shehab et al.
7,490,669 B2 2/2009 Walker et al.
7,520,333 B2 4/2009 Turner et al.
7,543,634 B2 6/2009 Fehr et al.
7,543,641 B2 6/2009 Contant
7,543,647 B2 6/2009 Walker
7,552,779 B2 6/2009 Murray
7,571,765 B2 8/2009 Themig
7,575,062 B2 8/2009 East, Jr.
7,607,487 B2 10/2009 Lucas et al.
7,640,977 B2 1/2010 Jonas
7,661,481 B2 2/2010 Todd et al.

(56) References Cited

U.S. PATENT DOCUMENTS

| | | | |
|---|---|---|---|
| 7,665,535 | B2 | 2/2010 | Van Wulfften Palthe |
| 7,681,645 | B2 | 3/2010 | McMillin et al. |
| 7,702,510 | B2 | 4/2010 | Eide et al. |
| 7,703,507 | B2 | 4/2010 | Strickland |
| 7,712,541 | B2 | 5/2010 | Loretz et al. |
| 7,735,559 | B2 | 6/2010 | Malone |
| 7,748,460 | B2 | 7/2010 | Themig et al. |
| 7,814,981 | B2 | 10/2010 | Marcu |
| 7,823,637 | B2 | 11/2010 | Corbett et al. |
| 7,832,472 | B2 | 11/2010 | Themig |
| 7,832,488 | B2 | 11/2010 | Guerrero et al. |
| 7,849,925 | B2 | 12/2010 | Patel |
| 7,866,396 | B2 | 1/2011 | Rytlewski |
| 7,891,774 | B2 | 2/2011 | Silverbrook |
| 7,896,088 | B2 | 3/2011 | Guerrero et al. |
| 7,909,108 | B2 | 3/2011 | Swor et al. |
| 8,091,641 | B2 | 1/2012 | Gambier et al. |
| 8,127,654 | B2 | 3/2012 | Williams et al. |
| 8,215,411 | B2 | 7/2012 | Flores et al. |
| 8,220,543 | B2 | 7/2012 | Clark et al. |
| 8,245,782 | B2 | 8/2012 | Sanchez |
| 8,272,443 | B2 | 9/2012 | Watson et al. |
| 8,276,674 | B2 | 10/2012 | Lopez de Cardenas et al. |
| 8,282,365 | B2 | 10/2012 | Obrejanu |
| 8,307,902 | B2 | 11/2012 | Telfer |
| 8,312,921 | B2 | 11/2012 | Gambier et al. |
| 8,403,068 | B2 | 3/2013 | Robison et al. |
| 8,453,734 | B2 | 6/2013 | Jasek et al. |
| 8,474,523 | B2 | 7/2013 | Rayssiguier et al. |
| 8,479,818 | B2 | 7/2013 | Rayssiguier et al. |
| 8,490,707 | B2 | 7/2013 | Robisson et al. |
| 8,505,632 | B2 | 8/2013 | Guerrero et al. |
| 8,511,380 | B2 | 8/2013 | Guignard et al. |
| 2001/0045290 | A1 | 11/2001 | Pringle et al. |
| 2002/0007949 | A1 | 1/2002 | Tolman et al. |
| 2002/0049575 | A1 | 4/2002 | Jalali et al. |
| 2002/0074128 | A1 | 6/2002 | Allamon et al. |
| 2002/0093431 | A1 | 7/2002 | Zierolf |
| 2002/0157837 | A1 | 10/2002 | Bode et al. |
| 2002/0158120 | A1 | 10/2002 | Zierolf |
| 2002/0166665 | A1 | 11/2002 | Vincent et al. |
| 2003/0019634 | A1 | 1/2003 | Henderson et al. |
| 2003/0070809 | A1 | 4/2003 | Schultz et al. |
| 2003/0070811 | A1 | 4/2003 | Robison et al. |
| 2003/0090390 | A1 | 5/2003 | Snider et al. |
| 2003/0111224 | A1 | 6/2003 | Hailey, Jr. et al. |
| 2003/0127227 | A1 | 7/2003 | Fehr et al. |
| 2003/0136562 | A1 | 7/2003 | Robison et al. |
| 2003/0180094 | A1 | 9/2003 | Madison |
| 2003/0234104 | A1 | 12/2003 | Johnston et al. |
| 2004/0020652 | A1 | 2/2004 | Campbell et al. |
| 2004/0040707 | A1 | 3/2004 | Dusterhoft et al. |
| 2004/0050551 | A1 | 3/2004 | Jones |
| 2004/0055749 | A1 | 3/2004 | Lonnes et al. |
| 2004/0084189 | A1 | 5/2004 | Hosie et al. |
| 2004/0092404 | A1 | 5/2004 | Murray et al. |
| 2004/0118564 | A1 | 6/2004 | Themig et al. |
| 2004/0129422 | A1 | 7/2004 | Themig |
| 2004/0231840 | A1 | 11/2004 | Ratanasirigulchai et al. |
| 2004/0238168 | A1 | 12/2004 | Echols |
| 2004/0262016 | A1 | 12/2004 | Farquhar |
| 2005/0178552 | A1 | 8/2005 | Fehr et al. |
| 2005/0199401 | A1 | 9/2005 | Patel et al. |
| 2005/0230118 | A1 | 10/2005 | Noske et al. |
| 2005/0279510 | A1 | 12/2005 | Patel et al. |
| 2006/0076133 | A1 | 4/2006 | Penno |
| 2006/0086497 | A1 | 4/2006 | Ohmer et al. |
| 2006/0090893 | A1 | 5/2006 | Sheffield |
| 2006/0090906 | A1 | 5/2006 | Themig |
| 2006/0124310 | A1 | 6/2006 | Lopez de Cardenas et al. |
| 2006/0124311 | A1 | 6/2006 | Lopez de Cardenas et al. |
| 2006/0124312 | A1 | 6/2006 | Rytlewski et al. |
| 2006/0124315 | A1 | 6/2006 | Frazier et al. |
| 2006/0144590 | A1 | 7/2006 | Lopez de Cardenas et al. |
| 2006/0157255 | A1 | 7/2006 | Smith |
| 2006/0207763 | A1 | 9/2006 | Hofman |
| 2006/0207764 | A1 | 9/2006 | Rytlewski |
| 2006/0207765 | A1 | 9/2006 | Hofman |
| 2006/0243455 | A1 | 11/2006 | Telfer et al. |
| 2007/0007007 | A1 | 1/2007 | Themig et al. |
| 2007/0044958 | A1 | 3/2007 | Rytlewski et al. |
| 2007/0084605 | A1 | 4/2007 | Walker et al. |
| 2007/0107908 | A1 | 5/2007 | Vaidya et al. |
| 2007/0144746 | A1 | 6/2007 | Jonas |
| 2007/0151734 | A1 | 7/2007 | Fehr et al. |
| 2007/0181224 | A1 | 8/2007 | Marya et al. |
| 2007/0227731 | A1 | 10/2007 | Contant |
| 2007/0272411 | A1 | 11/2007 | Lopez De Cardenas et al. |
| 2007/0272413 | A1 | 11/2007 | Rytlewski et al. |
| 2007/0284097 | A1 | 12/2007 | Swor et al. |
| 2008/0000697 | A1 | 1/2008 | Rytlewski |
| 2008/0099209 | A1 | 5/2008 | Loretz et al. |
| 2008/0105438 | A1 | 5/2008 | Jordan et al. |
| 2008/0164027 | A1 | 7/2008 | Sanchez |
| 2008/0210429 | A1 | 9/2008 | McMillin et al. |
| 2009/0056951 | A1 | 3/2009 | Mosher et al. |
| 2009/0065194 | A1 | 3/2009 | Frazier |
| 2009/0084553 | A1 | 4/2009 | Rytlewski et al. |
| 2009/0139726 | A1* | 6/2009 | Gomez ..... 166/373 |
| 2009/0158674 | A1 | 6/2009 | Guerrero et al. |
| 2009/0242206 | A1 | 10/2009 | Goughnour et al. |
| 2009/0260835 | A1 | 10/2009 | Malone |
| 2009/0294137 | A1 | 12/2009 | Meijer |
| 2010/0006193 | A1 | 1/2010 | Kneisl |
| 2010/0024327 | A1 | 2/2010 | Kennedy |
| 2010/0101803 | A1 | 4/2010 | Clayton et al. |
| 2010/0101807 | A1 | 4/2010 | Greenlee et al. |
| 2010/0132954 | A1 | 6/2010 | Telfer |
| 2010/0139930 | A1 | 6/2010 | Patel et al. |
| 2010/0163238 | A1 | 7/2010 | Zhan et al. |
| 2010/0209288 | A1 | 8/2010 | Marya |
| 2010/0319520 | A1 | 12/2010 | Williams et al. |
| 2011/0056692 | A1 | 3/2011 | Lopez de Cardenas et al. |
| 2011/0061875 | A1 | 3/2011 | Tips et al. |
| 2011/0127047 | A1 | 6/2011 | Themig et al. |
| 2011/0174493 | A1 | 7/2011 | Clem |
| 2011/0186298 | A1 | 8/2011 | Clark et al. |
| 2011/0240290 | A1 | 10/2011 | Jasek et al. |
| 2011/0240301 | A1 | 10/2011 | Robison et al. |
| 2011/0240311 | A1 | 10/2011 | Robison et al. |
| 2011/0278010 | A1 | 11/2011 | Fehr et al. |
| 2011/0284240 | A1 | 11/2011 | Chen et al. |
| 2012/0048559 | A1 | 3/2012 | Ganguly et al. |
| 2012/0067595 | A1 | 3/2012 | Noske et al. |
| 2012/0085538 | A1 | 4/2012 | Guerrero et al. |
| 2012/0085548 | A1 | 4/2012 | Fleckenstein et al. |
| 2012/0090847 | A1 | 4/2012 | Getzlaf et al. |
| 2012/0097398 | A1 | 4/2012 | Ravensbergen et al. |
| 2012/0152550 | A1 | 6/2012 | East |
| 2012/0168152 | A1 | 7/2012 | Casciaro |
| 2012/0175134 | A1 | 7/2012 | Robisson et al. |
| 2012/0292032 | A1 | 11/2012 | Themig et al. |
| 2012/0305265 | A1 | 12/2012 | Garcia et al. |
| 2012/0312557 | A1 | 12/2012 | King |
| 2013/0025868 | A1 | 1/2013 | Smith et al. |
| 2013/0025876 | A1 | 1/2013 | McCoy et al. |
| 2013/0062055 | A1 | 3/2013 | Tolman et al. |
| 2013/0067594 | A1 | 3/2013 | Kantor et al. |
| 2013/0068451 | A1 | 3/2013 | Getzlaf et al. |
| 2013/0075095 | A1 | 3/2013 | Rayssiguier et al. |
| 2013/0081827 | A1 | 4/2013 | Etzel |
| 2013/0092400 | A1 | 4/2013 | Stewart et al. |
| 2013/0112435 | A1 | 5/2013 | Fleming et al. |
| 2013/0112436 | A1 | 5/2013 | Fleming et al. |
| 2013/0161017 | A1 | 6/2013 | King |
| 2013/0168090 | A1 | 7/2013 | Themig et al. |
| 2013/0175040 | A1 | 7/2013 | Madero et al. |
| 2013/0186644 | A1 | 7/2013 | Smith et al. |
| 2013/0206402 | A1 | 8/2013 | Coon |
| 2013/0220603 | A1 | 8/2013 | Robison et al. |
| 2013/0233564 | A1 | 9/2013 | Pacey |
| 2013/0255939 | A1 | 10/2013 | Kumaran et al. |
| 2013/0255963 | A1 | 10/2013 | Guerrero et al. |
| 2013/0312960 | A1 | 11/2013 | Jasek et al. |

(56) References Cited

U.S. PATENT DOCUMENTS

| | | | |
|---|---|---|---|
| 2013/0319658 | A1 | 12/2013 | Huh et al. |
| 2013/0319669 | A1 | 12/2013 | Dupree et al. |
| 2013/0319687 | A1 | 12/2013 | Huh et al. |
| 2013/0333883 | A1 | 12/2013 | Ehtesham et al. |

FOREIGN PATENT DOCUMENTS

| | | | |
|---|---|---|---|
| GB | 2386624 | A | 9/2003 |
| GB | 2411189 | A | 8/2005 |
| GB | 2424233 | A | 9/2006 |
| GC | 0001546 | | 10/2011 |
| WO | 2000063520 | A1 | 10/2000 |
| WO | 2001007860 | A2 | 2/2001 |
| WO | 2001042620 | A1 | 6/2001 |
| WO | 2001073423 | A1 | 10/2001 |
| WO | 2001092687 | A2 | 12/2001 |
| WO | 2003095794 | A1 | 11/2003 |
| WO | 2004088091 | A1 | 10/2004 |
| WO | 2008086165 | A2 | 7/2008 |
| WO | 201005060 | A1 | 5/2010 |
| WO | 2010059060 | A1 | 5/2010 |
| WO | 2010112810 | A2 | 10/2010 |
| WO | 2010124371 | A1 | 11/2010 |
| WO | 2011058325 | A2 | 5/2011 |
| WO | 2011126633 | A1 | 10/2011 |
| WO | 2011146866 | A2 | 11/2011 |
| WO | 2012030843 | A2 | 3/2012 |
| WO | 2012045165 | A1 | 4/2012 |
| WO | 2012051705 | A1 | 4/2012 |
| WO | 2012054383 | A2 | 4/2012 |
| WO | 2012083047 | A2 | 6/2012 |
| WO | 2012091926 | A2 | 7/2012 |
| WO | 2012107730 | A2 | 8/2012 |
| WO | 2013028385 | A2 | 2/2013 |
| WO | 2013028801 | A1 | 2/2013 |
| WO | 2013048810 | A1 | 4/2013 |
| WO | 2013053057 | A1 | 4/2013 |
| WO | 2013055516 | A1 | 4/2013 |
| WO | 2012051705 | A9 | 5/2013 |
| WO | 2013070445 | A1 | 5/2013 |
| WO | 2013070446 | A1 | 5/2013 |
| WO | 2013074593 | A1 | 5/2013 |
| WO | 2013106259 | A1 | 7/2013 |
| WO | 2013150304 | A2 | 10/2013 |
| WO | 2013184301 | A1 | 12/2013 |
| WO | 2013184302 | A1 | 12/2013 |

OTHER PUBLICATIONS

Lonnes, S. B., Nygaard, K. J., Sorem, W. A., Hall, T. J., Tolman, R. C., Advanced Multizone Stimulation Technology, SPE 95778, Presented at the 2005 SPE Annual Technical Conference and Exhibition, Oct. 9-12, 2005, Dallas, TX, USA.

Rytlewski, G., Multiple-Layer Commpletions for Efficient Treatment of Multilayer Reservoirs, IADC/SPE 112476, Presented at the 2008 IADC/SPE Drilling Conference, Mar. 4-6, 2008, Orlando, FL, USA.

International Search Report issued in PCT/US2012/062098 on Mar. 4, 2013; 3 pages.

McDaniel, "Review of Current Fracture Stimulation Techniques for Best Economics in Multi-layer, Lower Permeability Reservoirs", SPE 98025—SPE Eastern Regional Meeting, Sep. 14-16, Morgantown, West Virginia, Sep. 2005, 19 pages.

* cited by examiner

COMPLETION METHOD FOR STIMULATION OF MULTIPLE INTERVALS

BACKGROUND

Hydrocarbon fluids are obtained from subterranean geologic formations, referred to as reservoirs, by drilling wells that penetrate the hydrocarbon-bearing formations. In some applications, a well is drilled through multiple well zones and each of those well zones may be treated to facilitate hydrocarbon fluid productivity. For example, a multizone vertical well or horizontal well may be completed and stimulated at multiple injection points along the well completion to enable commercial productivity. The treatment of multiple zones can be achieved by sequentially setting bridge plugs through multiple well interventions. In other applications, drop balls are used to open sliding sleeves at sequential well zones with size-graduated drop balls designed to engage seats of progressively increasing diameter.

SUMMARY

In general, the present disclosure provides a methodology and system for stimulating or otherwise treating multiple intervals/zones of a well by controlling flow of treatment fluid via a plurality of flow control devices. The flow control devices are provided with internal profiles and flow through passages. Hydraulic darts are designed for selective engagement with the internal profiles of specific flow control devices, and each dart may be moved downhole for engagement with and activation of a specific flow control device.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which facilitate multi-zonal completion and treatment of a well. For example, the methodology may comprise completing multizone vertical wells and/or horizontal wells that benefit from stimulation at multiple injection points along the wellbore to achieve commercial productivity. The individual well zones can be subjected to a variety of well treatments to facilitate production of desired hydrocarbon fluids, such as oil and/or gas. The well treatments may comprise stimulation treatments, such as fracturing treatments, performed at the individual well zones. However, a variety of other well treatments may be employed utilizing various types of treatment materials, including fracturing fluid, proppant materials, slurries, chemicals, and other treatment materials designed to enhance the productivity of the well. The present approach to multi-zonal completion and treatment reduces completion cycle times, increases or maintains completion efficiency, improves well productivity, and increases recoverable reserves.

Also, the well treatments may be performed in conjunction with many types of well equipment deployed downhole into the wellbore. For example, various completions may employ a variety of flow control devices which are used to control the lateral flow of fluid out of and/or into the completion at the various well zones. In some applications, the flow control devices are mounted along a well casing to control the flow of fluid between an interior and exterior of the well casing. However, flow control devices may be positioned along internal tubing or along other types of well strings/tubing structures deployed in the wellbore. The flow control devices may comprise sliding sleeves, valves, and other types of flow control devices which may be actuated by a member dropped down through the tubular structure.

Figure 1:
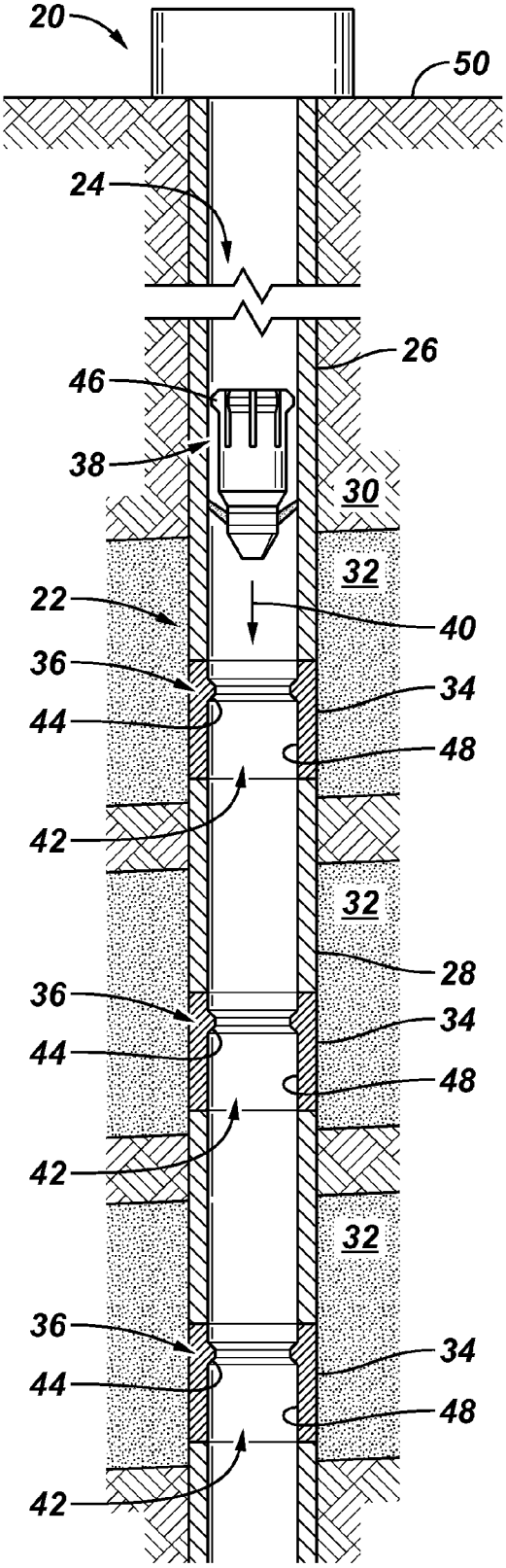
FIG. 1 is a schematic illustration of an example of a well system comprising a plurality of flow control devices that may be selectively actuated, according to an embodiment of the disclosure.

Referring generally to FIG. 1, an example of one type of application utilizing a plurality of flow control devices is illustrated. The example is provided to facilitate explanation, and it should be understood that a variety of well completion systems and other well or non-well related systems may utilize the methodology described herein. The flow control devices may be located at a variety of positions and in varying numbers along the tubular structure depending on the number of external zones to be treated.

In FIG. 1, an embodiment of a well system 20 is illustrated as comprising downhole equipment 22, e.g. a well completion, deployed in a wellbore 24. The downhole equipment 22 may be part of a tubing string or tubular structure 26, such as well casing, although the tubular structure 26 also may comprise many other types of well strings, tubing and/or tubular devices. Additionally, downhole equipment 22 may include a variety of components, depending in part on the specific application, geological characteristics, and well type. In the example illustrated, the wellbore 24 is substantially vertical and tubular structure 26 comprises a casing 28. However, various well completions and other embodiments of downhole equipment 22 may be used in a well system having other types of wellbores, including deviated, e.g. horizontal, single bore, multilateral, cased, and uncased (open bore) wellbores.

In the example illustrated, wellbore 24 extends down through a subterranean formation 30 having a plurality of well zones 32. The downhole equipment 22 comprises a plurality of flow control devices 34 associated with the plurality of well zones 32. For example, an individual flow control device 34 may control flow from tubular structure 26 into the surrounding well zone 32 or vice versa. In some applications, a plurality of flow control devices 34 may be associated with each well zone 32. By way of example, the illustrated flow control devices 34 may comprise sliding sleeves, although other types of valves and devices may be employed to control the lateral fluid flow.

As illustrated, each flow control device 34 comprises a seat member 36 designed to engage a dart 38 which is dropped down through tubular structure 26 in the direction illustrated by arrow 40. Each dropped dart 38 may be hydraulically controlled to selectively engage a specific seat member 36 of a specific flow control device 34 to enable actuation of that specific flow control device 34. For example, the hydraulic control may be exercised via hydraulic pressure and/or flow rate acting against the dart 38 and controlled from a surface location. Engagement of the dart 38 with the specific, corresponding seat member 36 is not dependent on matching the diameter of the seat member 36 with a diameter of the dart 38. In the embodiment of FIG. 1, for example, the plurality of flow control devices 34 and their corresponding seat members 36 may be formed with longitudinal flow through passages 42 having diameters which are of common size. This enables maintenance of a relatively large flow passage through the tubular structure 26 across the multiple well zones 32.

In the example illustrated, each seat member 36 comprises a profile 44, such as a lip, ring, unique surface feature, recess, or other profile which is designed to engage a corresponding engagement feature 46 of the dart 38. By way of example, the profile 44 may be formed in a sidewall 48 of seat member 36, the sidewall 48 also serving to create longitudinal flow through passage 42. In some applications, the engagement feature 46 is controlled by a hydraulically actuated mandrel which may be moved relative to a surrounding dart housing according to hydraulic input, e.g. hydraulic pressure and/or flow rate. The engagement feature 46 may be selectively actuated at a desired corresponding flow control device to prevent passage of the dart 38 and to enable shifting/actuation of that specific flow control device 34.

Figure 2:
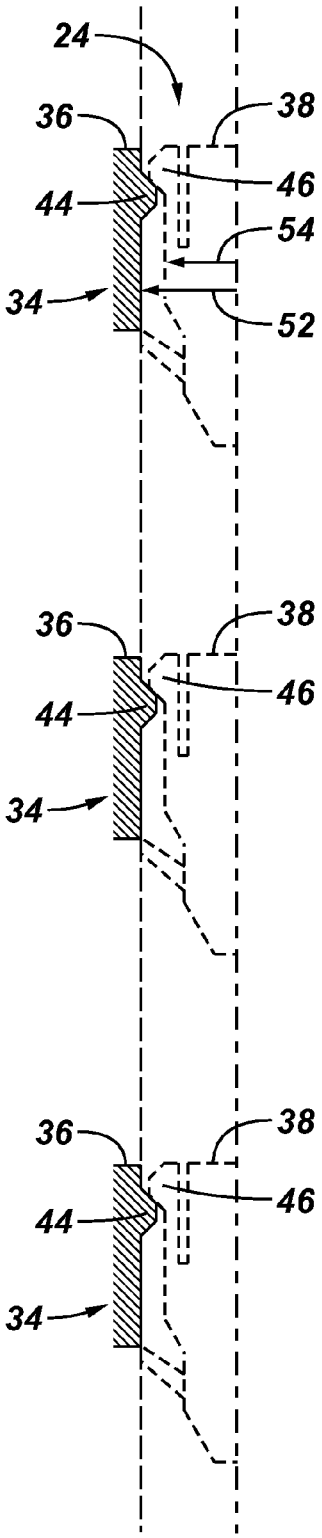
FIG. 2 is a schematic illustration of flow control devices engaged by corresponding hydraulic darts, according to an embodiment of the disclosure.

Referring generally to FIG. 2, a schematic example of a system and methodology for treating multiple well zones is illustrated. In this example, each flow control device 34 is actuated by movement of the seat member 36 once suitably engaged by a corresponding dart 38. Each seat member 36 comprises profile 44 which can be engaged by actuating the engagement feature 46 of dart 38 after dart 38 is delivered downhole from a surface location 50 (see FIG. 1). Because seating of the dart 38 is not dependent on decreasing seat diameters, a diameter 52 of each flow through passage 42 may be the same from one seat member 36 to the next. This enables construction of darts 38 having a common diameter 54 when in a radially contracted configuration during movement down through tubular structure 26 prior to actuation of the engagement feature 46 to a radially outward, locked position.

In one example of a multizone treatment operation, the darts 38 are selectively, hydraulically actuated in a manner enabling engagement of seat members 36 sequentially starting at the lowermost or most distal flow control device 34. The dart 38 initially dropped is pumped down through flow control devices 34 until the engagement feature 46 is actuated radially outwardly into engagement with the profile 44 of the lowermost seat member 36 illustrated in the example of FIG. 2. Once the initial dart 38 is seated in the distal seat member 36 and the engagement feature 46 is locked, pressure is applied through the tubular structure 26 and against the dart 38 to transition the seat member 36 and the corresponding flow control device 34 to a desired operational configuration. For example, the flow control device 34 may comprise a sliding sleeve which is transitioned to an open flow position to enable outward flow of a fracturing treatment or other type of treatment into the surrounding well zone 32.

After the initial well zone is treated, a subsequent dart 38 is dropped down through the flow through passages 42 of the upper flow control device or devices 34 until the engagement feature 46 is actuated and locked outwardly into engagement with the next sequential profile 44 of the next sequential flow control device 34. Pressure may then again be applied down through the tubular structure 26 to transition the flow control device 34 to a desired operational configuration which enables application of a desired treatment of the surrounding well zone 32. A third dart 38 may then be dropped for actuation and engagement with the seat member 36 of the third flow control device 34 to enable actuation of the third flow control device and treatment of the surrounding well zone. This process may be repeated as desired for each additional flow control device 34 and well zone 32. Depending on the application, a relatively large number of darts 38 is easily deployed to enable actuation of specific flow control devices along the wellbore 24 for the efficient treatment of multiple well zones.

The methodology may be used in cemented or open-hole completion operations, and darts 38 are used as free fall and/or pump-down darts to selectively engage and operate sliding sleeves or other types of flow control devices 34. Additionally, the darts 38 may be designed to enable immediate flow back independent of chemical processes or milling to remove plugs. In open-hole applications, hydraulic set external packers or swellable packers may be used to isolate well zones along wellbore 24.

In one example of an application, the flow control devices 34 are sliding sleeve valves which are initially run-in-hole with the casing 28 to predetermined injection point depths for a fracture stimulation. A casing cementation operation is then performed utilizing, for example, standard materials and procedures. In open-hole applications, open-hole packers may be used instead of cementation. Prior to fracture stimulation, a pressure activated sliding sleeve valve set opposite the deepest injection point is opened or, alternatively, this interval can be perforated using a variety of perforating techniques. In other applications, the sliding sleeve valve at the deepest injection point may be opened via the initial dart 38.

After creating the desired opening or openings at the deepest injection point, fracture treatment fluid is pumped into this first interval. During a treatment flush, a dart 38 is pumped down and this initial dart is actuated to engage a specific sliding sleeve 34. In some applications, the first interval may not be fracture treated but instead used to allow pumping down the first dart 38. When the dart 38 engages, fluid is pumped to increase pressure until the sliding sleeve 34 shifts to an open position. At this stage, the fracture treatment fluid is pumped downhole and into the surrounding well zone 32. This process of launching darts 38 in the treatment flush is continued until all of the intervals/well zones 32 are treated. The well may be flowed back immediately or shut-in for later flow back. The darts 38 may later be removed via milling, dissolving, or through other suitable techniques to restore the unrestricted internal diameter of the casing.

Figure 3:
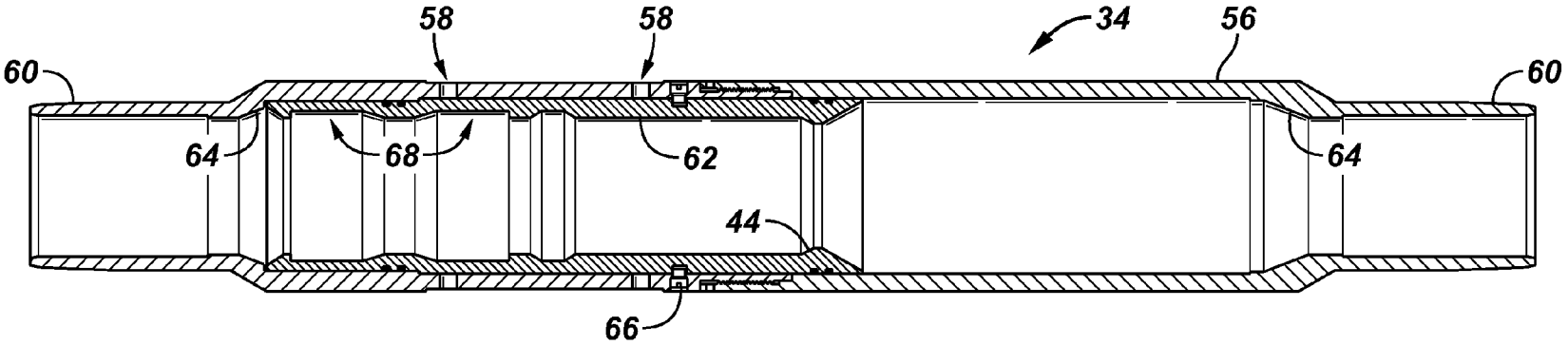
FIG. 3 is a cross-sectional illustration of an example of a flow control device, according to an embodiment of the disclosure.

The flow control devices 34 may comprise a variety of devices, including sliding sleeves. One example of a flow control device/sliding sleeve valve 34 is illustrated in FIG. 3. In this embodiment, the sliding sleeve valve 34 comprises a ported housing 56 designed for running into the well with the casing 28. The housing 56 comprises at least one flow port 58 to enable radial or lateral flow through the housing 56 between an interior and an exterior of the housing. The housing 56 also may comprise end connections 60, e.g. casing connections, for coupling the housing 56 to the casing 38 or to another type of tubular structure 26.

In the embodiment illustrated, seat member 36 is in the form of a sliding sleeve 62 slidably positioned along an interior surface of the housing 56 between containment features 64. During movement downhole, the sliding sleeve 62 may be held in a position covering flow ports 58 by a retention member 66, such as a shear screw. The sliding sleeve 62 further comprises profile 44 designed to engage the engagement feature 46 of a dart 38 when the engagement feature 46 is in an actuated position. In some applications, the sliding sleeve 62 may comprise a secondary profile 68 designed to engage, for example, a suitable shifting tool. The secondary profile 68 provides an alternative way to open or close the sliding sleeve valve 34. When a designated dart 38 is engaged with profile 44 via engagement feature 46, application of pressure against the dart 38 causes retention member 66 to shear or otherwise release, thus allowing sliding sleeve 62 to transition along the interior of housing 56 until ports 58 are opened to lateral fluid flow. The seated dart 38 also isolates the casing volume below the sliding sleeve valve 34.

According to various environments described herein, the hydraulic darts 38 may be controlled from the surface using gross changes to flow or pressure. Both flow change and pressure change types of hydraulic darts 38 generally are designed so that a dart will temporarily seat against profile 44 and then pass through the flow control device 34 after a certain pressure is exceeded, e.g. after an applied pressure is sufficient to flex a collet carrying engagement feature 46. In one embodiment of pressure controlled hydraulic darts, a mandrel is moved relative to a collet in response to a pressure differential across the dart 38. A spring member is used to counter movement of the mandrel by pushing the mandrel in an uphole direction. The stiffness of the spring member is selected such that it will compress at a differential pressure (delta P) less than that required to push the engagement feature 46 past the internal profile 44. An orifice is used to regulate the flow of control fluid between two sides of a piston attached to the mandrel. Additionally, a check valve may be provided in parallel with the orifice to allow the mandrel to move back to its rest position at a quicker rate.

Figure 4:
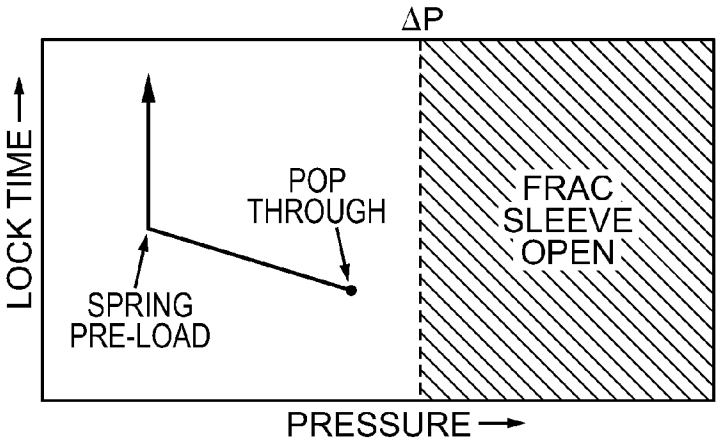
FIG. 4 is a graphical representation illustrating the time delay in pressure buildup used to actuate an embodiment of a hydraulic dart, according to an embodiment of the disclosure.

The orifice introduces a timing factor. For example, a certain amount of time is required for the mandrel to complete its motion and to lock the engagement feature 46 in place. If the pressure differential increases during the mandrel transition interval, the dart 38 is moved through the flow control device 34 and re-set. Additionally, a dart 38 that has been set by locking engagement feature 46 for interaction with profile 44 can be released by dropping the pressure below a spring pressure level and waiting a predetermined period of time to allow the mandrel to re-set. Once re-set, an increase in the pressure difference above the pressure differential needed to move the engagement feature 46 past the internal profile 44 allows the dart 38 to be pumped through that particular flow control device. In FIG. 4, a graphical representation is provided to express the relationship between pressure and time used either to actuate the engagement feature 46 for engagement with profile 44 and actuation of the flow control device 34, e.g. a frac sleeve, or to enable the dart 38 to be pumped past the flow control device 34.

Figure 5:
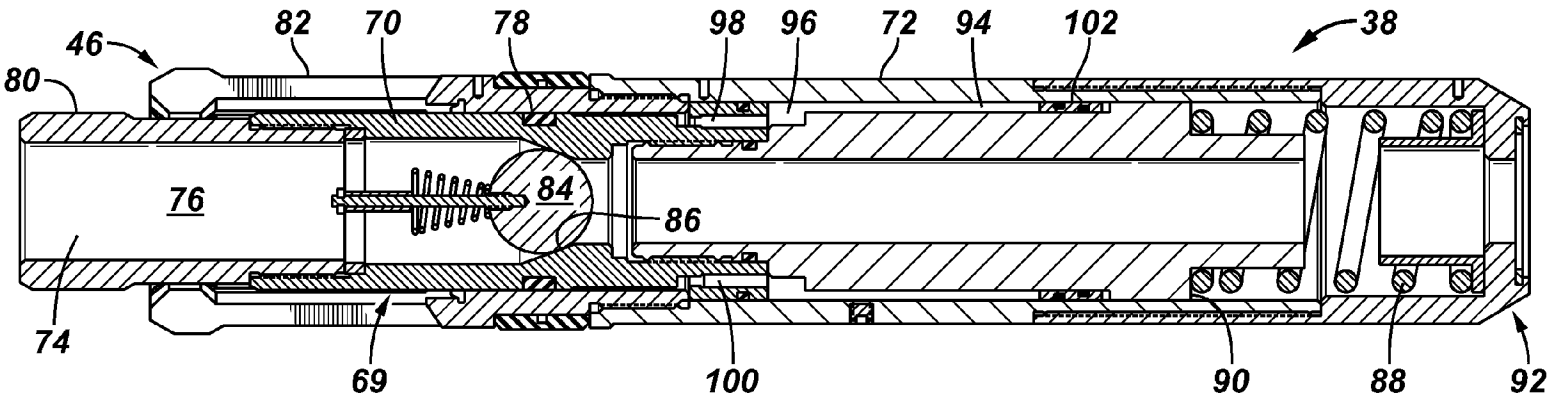
FIG. 5 is a cross-sectional view of an example of a hydraulic dart, according to an embodiment of the disclosure.

Referring generally to FIG. 5, an example of hydraulic dart 38 is illustrated. In the illustrated embodiment, pressure differentials may be created from a surface location and used to actuate the dart 38 for retention at a specific flow control device 34 or to move the dart 38 past the flow control device 34. The hydraulic dart 38 may comprise a hydraulic actuation system 69 comprising a mandrel 70 slidably mounted within a surrounding dart housing 72. The mandrel 70 may have an open interior 74 which forms part of an overall dart flow through passage 76. The mandrel 70 may be sealingly engaged with the surrounding dart housing 72 via at least one mandrel seal 78. Additionally, mandrel 70 is coupled to a locking member 80, such as a locking ring or shoulder, positioned to engage and lock the engagement feature 46 in a radially outward position when mandrel 70 is transitioned linearly to an actuated position. By way of example, engagement feature 46 may be mounted on a collet 82 coupled to or formed as part of dart housing 72.

Figure 6:
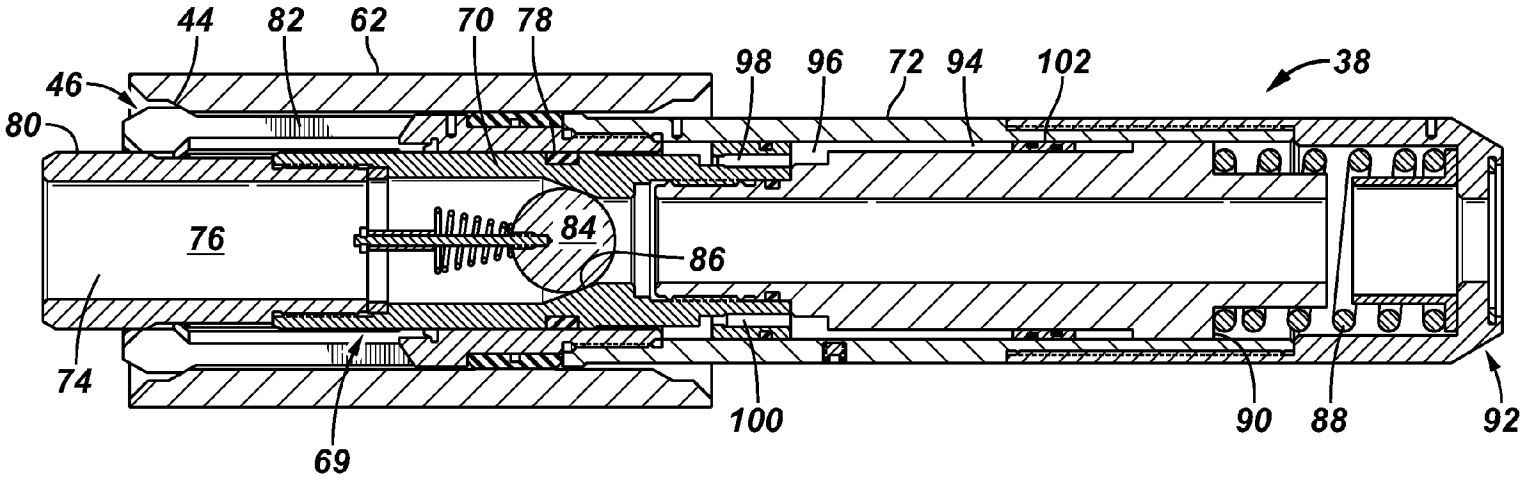
FIG. 6 is a cross-sectional view of the hydraulic dart illustrated in FIG. 4 but in a different operational position, according to an embodiment of the disclosure.

Within open interior 74, a ball or other type of flow blocking member 84 is positioned to seat against an internal seat 86 within mandrel 70. The flow blocking member 84 and internal seat 86 cooperate to function as a check valve which allows pressure to be applied in a downhole direction while allowing flow back in an uphole direction. Pumping down fluid against dart 38 and member 84 tends to shift mandrel 70 with respect to the dart housing 72, as illustrated in FIG. 6. However, this relative movement of mandrel 70 is resisted by a spring member 88 located, for example, between a shoulder 90 of mandrel 70 and a lead end 92 of dart 38.

Figure 7:
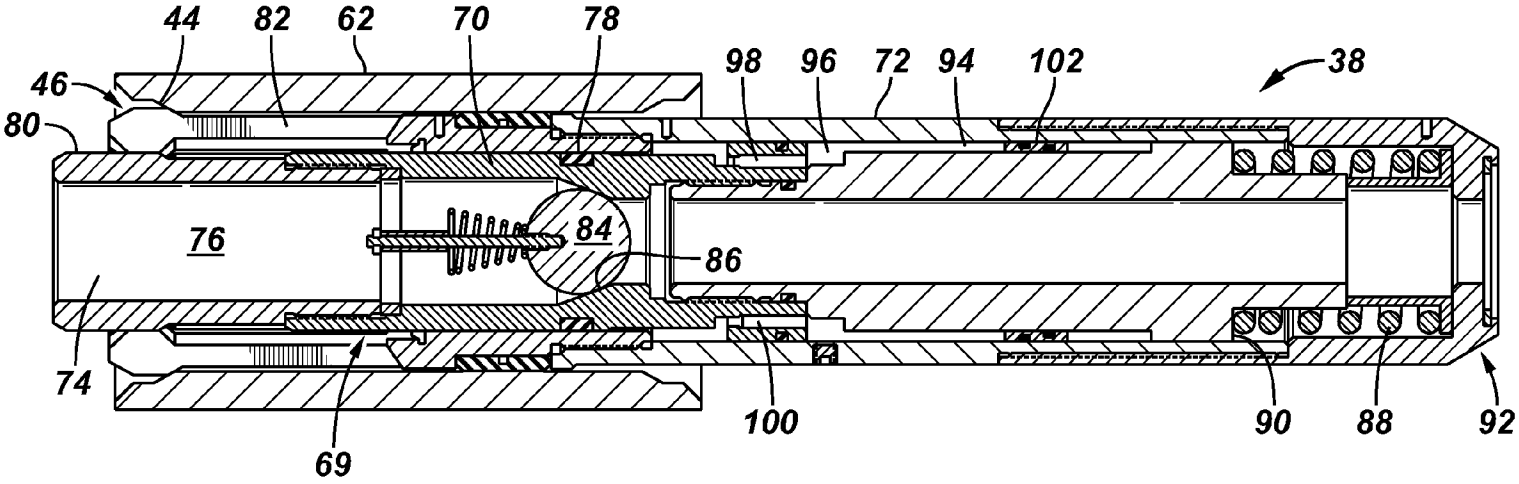
FIG. 7 is a cross-sectional view of the hydraulic dart illustrated in FIG. 4 but in a different operational position, according to an embodiment of the disclosure.

The illustrated example of dart 38 further comprises an internal cavity 94 containing an internal fluid 96, e.g. hydraulic fluid, which passes through an orifice 98 as mandrel 70 is moved relative to dart housing 72. The orifice 98 controls locking of engagement feature 46 according to a predetermined pressure and time period. For example, pressure from above may be applied against dart 38 to create a pressure differential sufficient to overcome spring member 88 without pushing engagement feature 46 and collet 82 past the internal profile 44. While this pressure level is held, the mandrel 70 is transitioned relative to dart housing 72 until locking member 80 locks engagement feature 46 and collet 82 in the radially outward position against internal profile 44, as illustrated in FIG. 7. In this locked position, the pressure differential can be increased to cause dart 38 to shift the flow control device 34/sliding sleeve 62 to a desired position.

Figure 8:
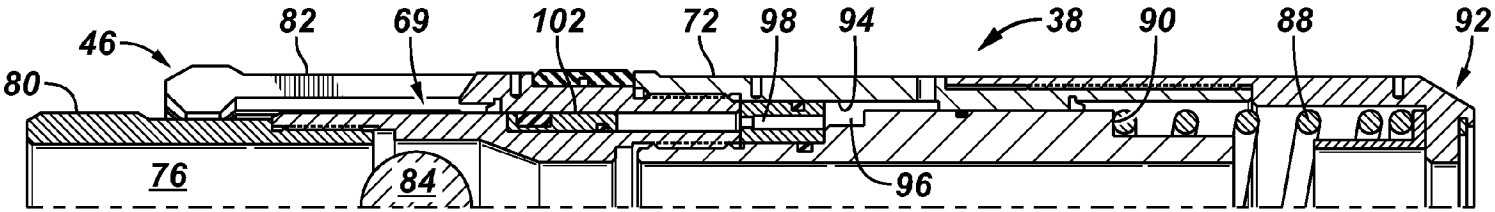
FIG. 8 is a cross-sectional view of an alternate embodiment of a hydraulic dart, according to an embodiment of the disclosure.

If the pressure differential is sufficiently decreased, spring member 88 is able to shift mandrel 70 with respect to dart housing 72 back to its original re-set position. A check valve 100 may be employed to enable faster return of the mandrel 72 its original position by allowing a freer flow of the internal dart fluid 96 as the mandrel 70 transitions back through dart housing 72. In the embodiment illustrated, a compensator piston 102 also is positioned within internal cavity 94 and acts against internal fluid 96. The compensator piston 102 can move to allow the total volume of internal fluid 96, e.g. oil, in the dart 38 to change due to, for example, thermal expansion. In an alternate embodiment, the compensator piston 102 may be located above or on an opposite side of orifice 98, as illustrated in FIG. 8. In this latter embodiment, the compensator piston 102 is positioned so it will not be moved by the pressure across the orifice 98 during cycling. In this example, the compensator piston 102 has an inside diameter which matches the outside diameter of the mandrel seal 78.

In the table below, various states of the mandrel 70 and the corresponding functions of dart 38 are set forth based on the pressure differential applied to the dart. In this example, the pressure differential may be lower or higher than the pressure differential required to compress spring member 88, to flex collet 82 (i.e. move engagement feature 46 past the internal profile 44), and/or to shear the shear member 66 of the flow control device 34 engaged by the dart 38. Various pressure differentials, mandrel states, and dart functions can be provided as follows:

| Pressure differential is | Mandrel state | |
|---|---|---|
| Lower than spring, collet, and shear screws | Up/unlocked | Dart will stay in sleeve |
| Lower than spring, collet, and shear screws | Down/locked | Dart will stay in sleeve, mandrel will move up |
| Higher than spring, lower than collet, lower than shear screws | Up/unlocked | Dart will stay in sleeve, mandrel will move down |
| Higher than spring, lower than collet, lower than shear screws | Down/locked | Dart will stay in sleeve, mandrel will stay down |
| Higher than spring and collet, lower than shear screws | Up/unlocked | Dart will pass through |
| Higher than spring and collet, lower than shear screws | Down/locked | Dart will stay in sleeve, mandrel will stay down |
| Higher than spring, collet, and shear screws | Up/unlocked | Dart will pass through |
| Higher than spring, collet, and shear screws | Down/locked | Screws will shear and sleeve will open |

Figure 9:
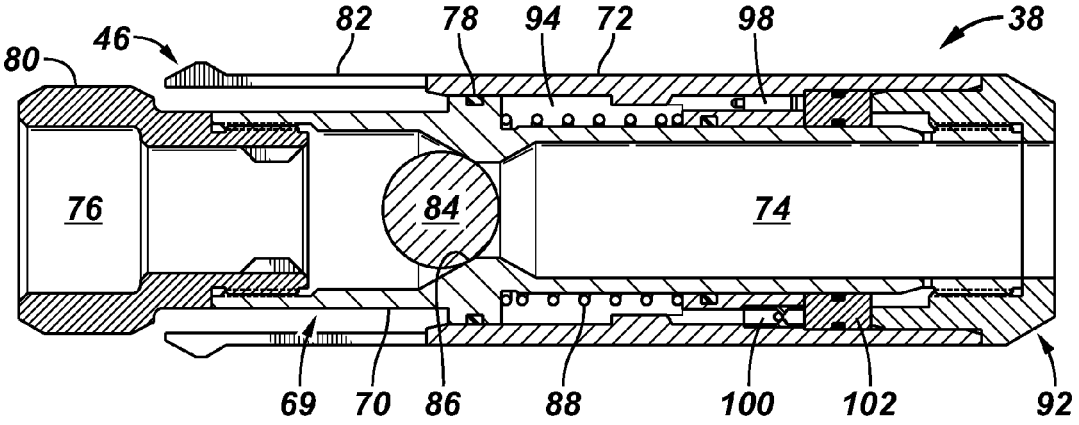
FIG. 9 is a cross-sectional view of another alternate embodiment of a hydraulic dart, according to an embodiment of the disclosure.
Figure 10:
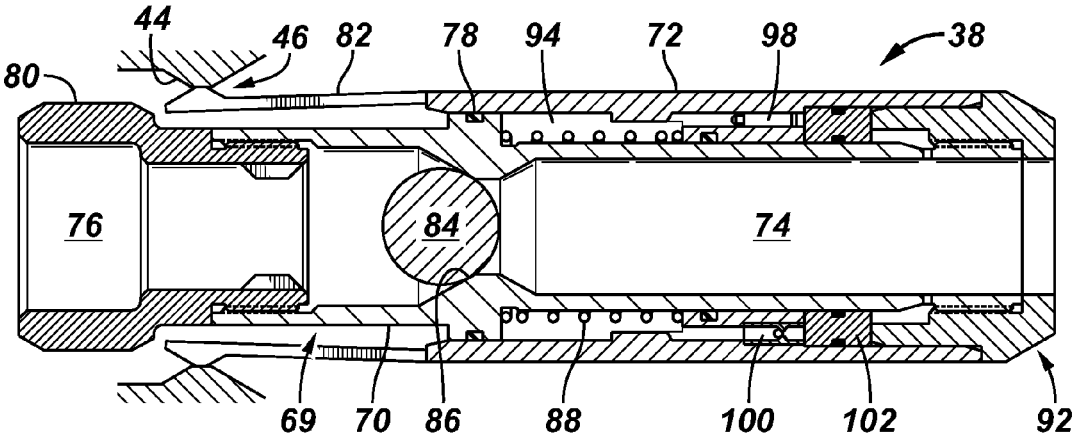
FIG. 10 is a cross-sectional view of the hydraulic dart illustrated in FIG. 9 positioned adjacent an internal profile of a flow control device, according to an embodiment of the disclosure.
Figure 11:
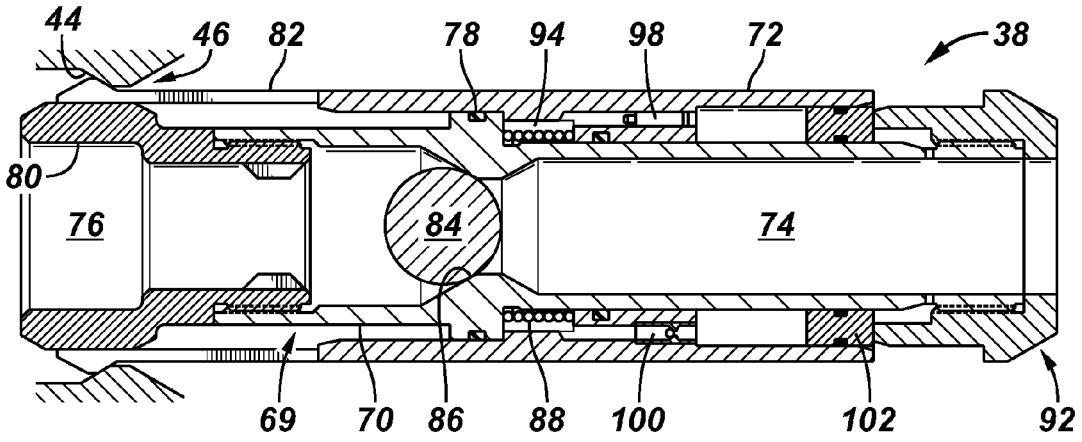
FIG. 11 is a cross-sectional view of the hydraulic dart illustrated in FIG. 9 but in a different operational position, according to an embodiment of the disclosure.

Referring generally to FIGS. 9-11, an alternate embodiment of the hydraulic dart 38 is illustrated. In this embodiment, the compensator piston 102 has an outside diameter that matches the outside diameter of the mandrel seal 78. Additionally, the spring member 88 is located within internal cavity 94 containing internal fluid 96, e.g. hydraulic oil. Otherwise, the functionality of the alternate hydraulic dart 38 is substantially similar to that described above with reference to the embodiments of FIGS. 4-8.

For example, the hydraulic dart 38 may be pumped down through the casing 38 or other tubular structure in and unactuated configuration, as illustrated in FIG. 9. When the engagement feature 46 contacts the internal profile 44 of a given flow control device 34, a rapid increase in pressure can be used to move the engagement feature past the internal profile 44, as illustrated in FIG. 10. However, a maintained pressure differential sufficient to compress spring member 88 without forcing engagement feature 46 past the internal profile 44 allows shifting of mandrel 70 to actuate the hydraulic dart 38 by moving the locking member 80 into a position adjacent the engagement feature 46, as illustrated in FIG. 11. This locks the engagement feature 46 in a radially outward position and prevents it from passing through the flow control device. In this configuration, increased pressure can be used to actuate/shift the flow control device 34.

Figure 12:
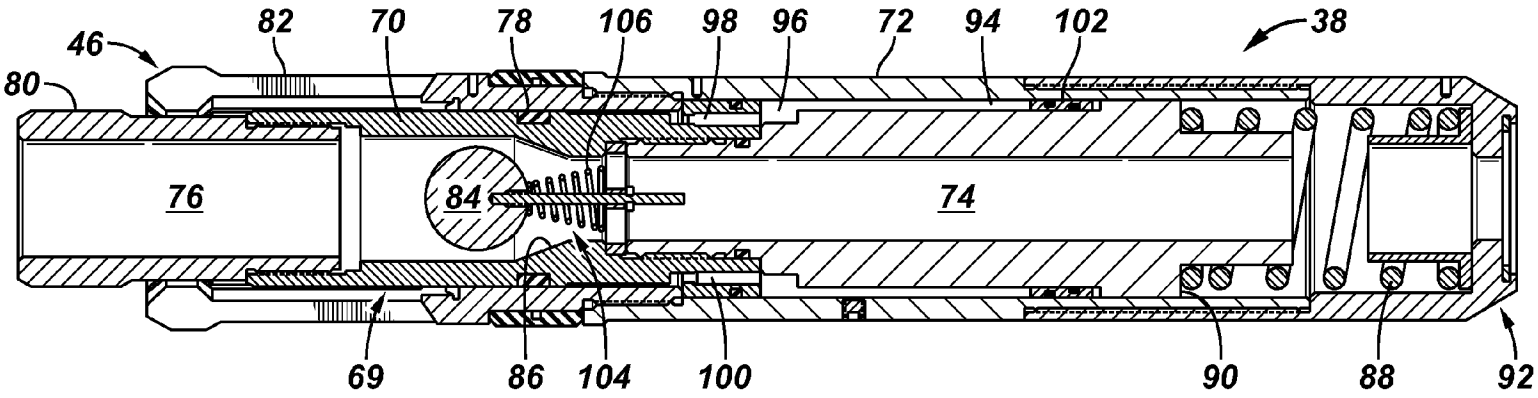
FIG. 12 is a cross-sectional view of an alternate embodiment of the hydraulic dart, according to an embodiment of the disclosure.

Referring generally to FIGS. 12-15, another alternate embodiment of the hydraulic dart 38 is illustrated. In this embodiment, the hydraulic dart 38 is flow controlled instead of pressure controlled. As illustrated in FIG. 12, the internal flow blocking member 84 is in the form of a velocity fuse 104 instead of a simple ball or similar flow blocking member. Below a predetermined rate of flow, the flow blocking member 84, e.g. velocity fuse 104, is held open by a spring 106. Once the predetermined flow rate is exceeded, the drag force on the velocity fuse 104 forces it to compress the spring 106. As the velocity fuse 104 moves close to the seat 86, the force on the velocity fuse 104 increases in a positive feedback cycle which causes rapid movement toward and against the seat 86.

The velocity fuse 104 remains against seat 86 as long as the pressure above the velocity fuse 104 is higher than below. If the pressure differential is reduced to a level which allows the spring 106 to push the velocity fuse off the corresponding seat 86, the flow blocking member 84 is again shifted to an open position. If the available flow is less than the predetermined flow rate, the flow blocking member 84/velocity fuse 104 remains open.

A pressure differential is produced by the fluid flowing through the velocity fuse 104. If this pressure differential times the area of the mandrel seal 78 exceeds the spring preload of spring member 88, the mandrel 70 is shifted and spring member 88 is compressed. This flow rate can be referred to as the spring flow rate. Similarly, there is a predetermined flow rate which creates a sufficient pressure differential so that engagement feature 46 can be moved past the internal profile 44, e.g. the collet 82 can collapse to allow passage of the engagement feature 46. This flow rate can be referred to as the collet flow rate.

Figure 13:
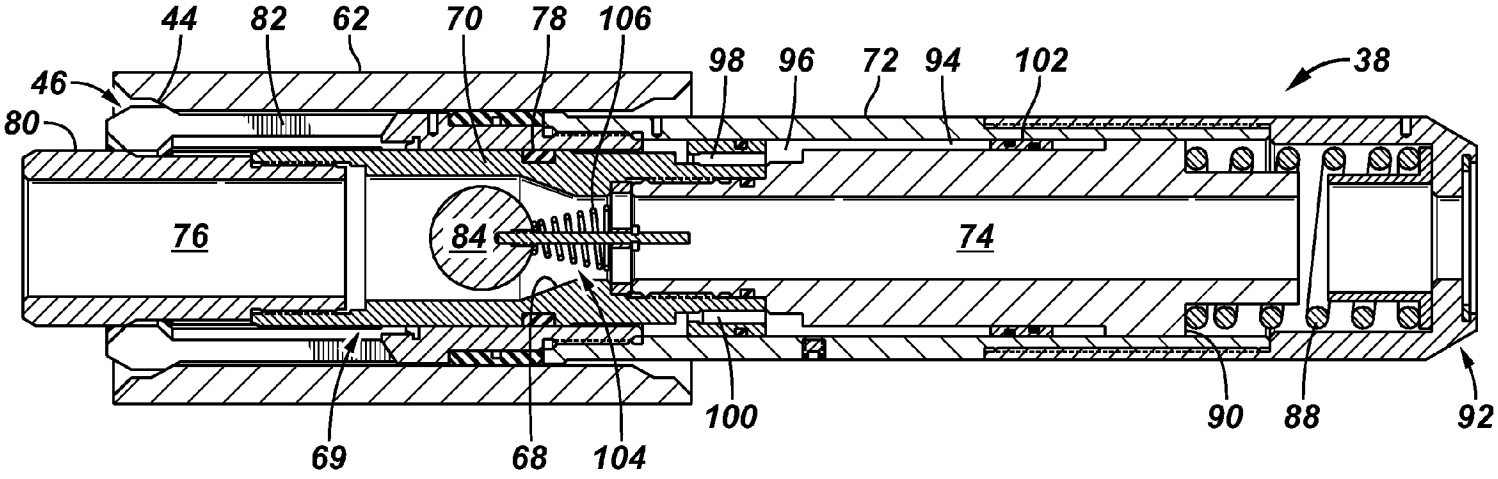
FIG. 13 is a cross-sectional view of the hydraulic dart illustrated in FIG. 12 engaging an internal profile of a flow control device, according to an embodiment of the disclosure.
Figure 14:
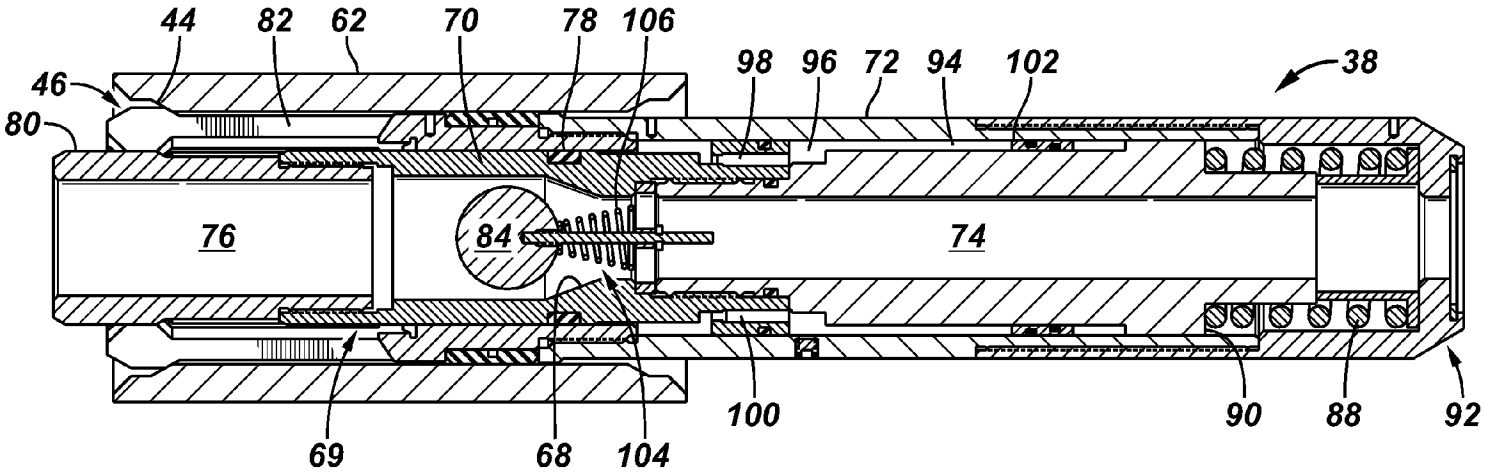
FIG. 14 is a cross-sectional view of the hydraulic dart illustrated in FIG. 12 but in a different operational position, according to an embodiment of the disclosure.
Figure 15:
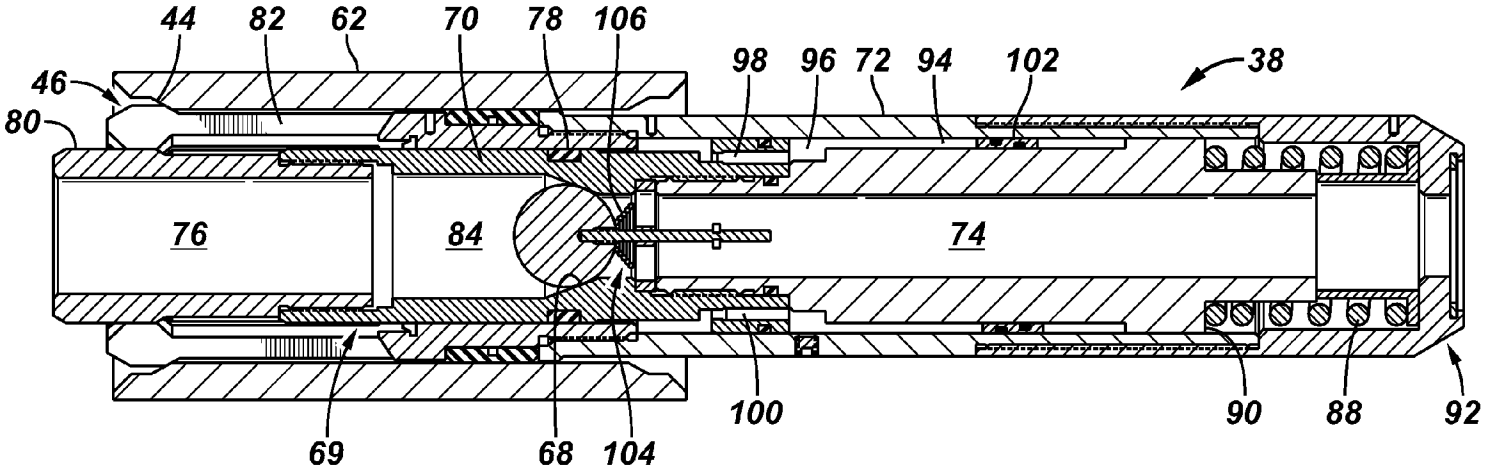
FIG. 15 is a cross-sectional view of the hydraulic dart illustrated in FIG. 12 but in a different operational position, according to an embodiment of the disclosure.

In operation, the dart 38 is dropped or pumped down until the engagement feature 46 engages the internal profile 44 of a flow control device 34, as illustrated in FIG. 13. If the flow rate is increased to the spring flow rate, spring member 88 is compressed and mandrel 70 is shifted until locking member 80 locks engagement feature 46 in the radially outward position, as illustrated in FIG. 14. The flow rate may then be increased to close the velocity fuse 104 which enables application of pressure against the dart 38 to shift the flow control device 34 to a different operational position, as illustrated in FIG. 15. Of course, if the flow rate is rapidly increased before the mandrel 70 is shifted, the pressure differential overcomes the collet 82 and moves the dart 38 past profile 44 and past the corresponding flow control device 34. Shifting of the mandrel 70 and actuation of the hydraulic dart 38 involves a time factor or time period to allow transition of mandrel 70 and locking of engagement feature 46, as described above and as illustrated in the graph of FIG. 4.

In the table below, various states of the mandrel 70 and the velocity fuse 104 along with the corresponding functions of dart 38 are set forth based on the flow rate conditions applied to the dart. In this example, the flow rate may be lower or higher than required to compress spring member 88, to flex collet 82 (i.e. move engagement feature 46 past the internal profile 44), and/or to close the velocity fuse 104. Various flow rate conditions, mandrel states, velocity fuse states, and dart functions can be provided as follows:

| Conditions | Mandrel state | Velocity Fuse | Results |
|---|---|---|---|
| Flow below spring, collet, and fuse rates | Up/unlocked | Open | Dart stay in the sleeve, mandrel stays up |
| Flow below spring, collet, and fuse rates | Down/locked | Open | Dart stays in the sleeve, mandrel moves up and unlocks |
| Flow above spring rate but below collet and fuse rates | Up/unlocked | Open | Dart stays in the sleeve, mandrel moves down and locks |
| Flow above spring rate but below collet and fuse rates | Down/locked | Open | Dart stays in the sleeve, mandrel stays down and locked |
| Flow above the spring and collet rates but below the fuse rate | Up/unlocked | Open | Dart passes through |
| Flow above the spring and collet rates but below the fuse rate | Down/locked | Open | Dart stays in the sleeve, mandrel stays down and locked |
| Flow above the spring, collet, and fuse rates | Up/unlocked | Open | Dart passes through, velocity fuse closes momentarily. |
| Flow above the spring, collet, and fuse rates | Down/locked | Open | Dart stays in the sleeve, mandrel stays down and locked, velocity fuse closes |
| Flow above the spring, collet, and fuse rates | Down/locked | Closed | Dart stays in the sleeve, mandrel stays down and locked, velocity fuse stays closed, frac sleeve opens |

If the flow control dart 38 is set in the wrong flow control device/sliding sleeve 34, the dart 38 may be released by sufficiently lowering the flow rate to release the collet 82/engagement feature 46 from locking member 80.

In some applications, the hydraulic darts 38 may be modified to add a pressure relief valve in parallel with the orifice 98 to allow high flows/pressures to lock the dart 38 more quickly. Additionally, the darts 38 may be used with feedback systems to track the darts position at the surface. For example, each passage of the dart 38 through a corresponding internal profile 44 generates a pressure pulse that can be counted at the surface. Additionally, when dart 38 is set or locked in engagement with a corresponding internal profile 44, the dart can serve as a two-way reflector which can be pinged from the surface to verify position before committing to a final pressure increase to open or otherwise change the configuration of the flow control device.

Figure 16:
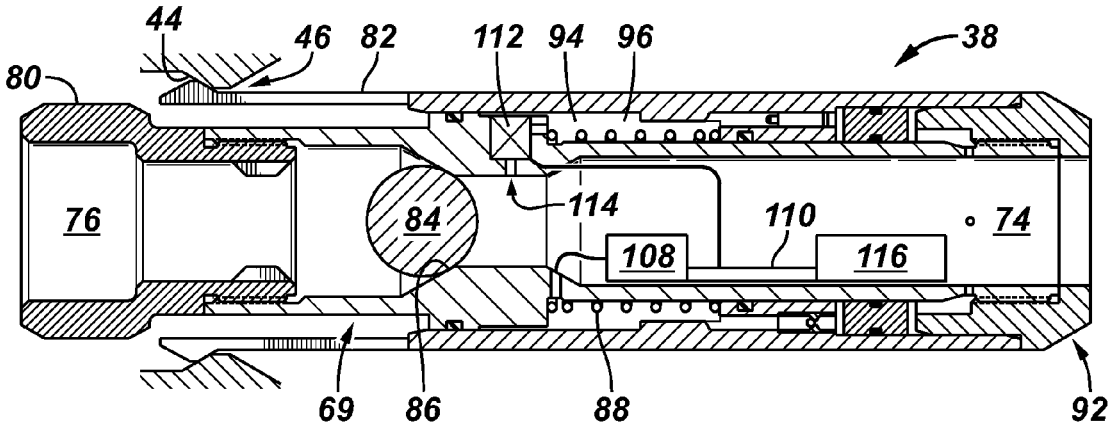
FIG. 16 is a cross-sectional view of an alternate embodiment of the hydraulic dart, according to an embodiment of the disclosure.

Referring generally to FIG. 16, another alternate dart configuration is illustrated. In this embodiment, each dart 38 is designed with electronics to count the number of times dart 38 passes through an internal profile 44 to facilitate actuation of the dart at the desired flow control device 34. In this example, the dart 38 comprises a sensor 108 which senses the change in internal pressure each time dart 38 encounters an internal profile 44 of a sliding sleeve 34 or other flow control device. The delay section pressure increases such that the electronic sensor 108 can detect the passage and electronics 110 can be used to count the number of sliding sleeves or other flow control devices 34 traversed by the dart 38. Just prior to engaging the specific, desired flow control device 34, electronics 110 activates a solenoid valve 112 which, in turn, opens a bypass 114 that serves to bypass the restrictor valve. This allows the locking member 82 to actuate the dart 38 by locking the collet 82/engagement feature 46, thus permitting actuation of the flow control device 34. Power may be supplied to electronics 110 and to solenoid valve 112 by a power source 116, such as a battery.

The system and methodology described herein may be employed in non-well related applications which require actuation of devices at specific zones along a tubular structure. Similarly, the system and methodology may be employed in many types of well treatment applications and other applications in which devices are actuated downhole via dropped darts without requiring any changes to the diameter of the internal fluid flow passage. Different well treatment operations may be performed at different well zones without requiring separate interventions operation. Sequential darts may simply be dropped into engagement with specific well devices for actuation of those specific well devices at predetermined locations along the well equipment positioned downhole.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of treating a plurality of well zones, comprising:

providing each flow control device of a plurality of flow control devices with an internal profile and a flow through passage;

locating the plurality of flow control devices along a casing in a wellbore; and selecting a plurality of darts constructed for engagement with the internal profile of specific flow control devices of the plurality of flow control devices;

releasing each dart of the plurality of darts for engagement with the internal profile of the specific flow control device;

selectively actuating each dart downhole to engage the internal profile of the specific flow control device by controlling the fluid acting on the dart over a predetermined time period: wherein selectively actuating comprises:

shifting a mandrel within a housing; and controlling the rate of shifting of the mandrel using an orifice to restrict flow of an internal fluid; and creating a fluid barrier via engagement with the internal profile for enabling a stimulation operation.

2. The method as recited in claim 1, wherein providing comprises providing a plurality of sliding sleeves.

3. The method as recited in claim 1, wherein providing comprises providing each flow through passage of each flow control device with the same diameter.

4. The method as recited in claim 1, wherein selecting comprises constructing each dart of the plurality of darts with a check valve oriented to allow fluid flow back through the flow through passage.

5. The method as recited in claim 1, wherein selectively actuating comprises controlling each dart from the surface via changes in pressure of the fluid acting against the dart.

6. The method as recited in claim 1, wherein selectively actuating comprises controlling each dart from the surface via changes in flow of the fluid acting against the dart.

7. The method as recited in claim 1, wherein selectively actuating further comprises shifting the mandrel within to lock an engagement feature in a position for engagement with the internal profile of a desired flow control device.

8. The method as recited in claim 7, further comprising providing an abrupt increase in pressure prior to the mandrel locking the engagement feature to enable movement of the dart past the flow control device.

9. The method as recited in claim 7, further comprising providing an abrupt increase in flow rate prior to the mandrel locking the engagement feature to enable movement of the dart past the flow control device.

10. The method as recited in claim 1, further comprising resisting shifting of the mandrel with a spring member.

11. The method as recited in claim 10, further comprising placing a check valve in parallel with the orifice to facilitate return of the mandrel to an original rest position.

12. The method as recited in claim 1, further comprising exposing the internal fluid to a compensator piston.

13. A system for use in treating a well, comprising:

a dart having an engagement member shaped to engage an internal profile of a flow control device located in a well completion having a plurality of flow control devices, the dart further comprising a mandrel slidably mounted in a dart housing such that shifting of the mandrel is used to secure the engagement member for sealing engagement with the internal profile of a desired flow control device to create a fluid barrier at the flow control device, a rate of shifting the mandrel being controlled by restricting flow of an internal dart fluid.

14. The system as recited in claim 13, wherein the rate of shifting the mandrel is controlled by an orifice.

15. The system as recited in claim 13, wherein the dart further comprises a compensator piston exposed to the internal dart fluid.

16. The system as recited in claim 13, wherein the dart further comprises a flow through passage extending through the mandrel and a check valve for selectively blocking flow through the flow through passage.

17. A method, comprising:

deploying a multizone well stimulation system into a wellbore with a plurality of flow control devices;

providing each dart of a plurality of darts with a hydraulic actuation system which is hydraulically manipulated via changes in flow rate or pressure acting on the dart through the multizone well stimulation system, wherein each dart includes a mandrel which is selectively moved hydraulically and the movement of the dart is controlled by restricting flow of an internal dart fluid via an orifice;

releasing individual darts into the multizone well stimulation system for engagement with the predetermined flow control device; and using the changes in flow rate or pressure to actuate the dart into engagement with a predetermined flow control device of the plurality of flow control devices, thus enabling actuation of the predetermined flow control device to a different operational position.

18. The method as recited in claim 17, wherein the mandrel is selectively moved to lock an engagement feature into an engagement position.

* * * * *